United States Patent [19]

Jenkins

[11] Patent Number: 5,072,535

[45] Date of Patent: Dec. 17, 1991

[54] ILLUMINATED SIGN WITH SELF-SUPPORTING DISPLAY BOX

[75] Inventor: Sandra D. Jenkins, Somerville, Ala.

[73] Assignee: Southern Communications, Inc., Huntsville, Ala.

[21] Appl. No.: 529,504

[22] Filed: May 29, 1990

[51] Int. Cl.[5] ..... G09F 13/04

[52] U.S. Cl. ..... 40/564; 40/575

[58] Field of Search ..... 40/564, 568, 572, 574, 40/607, 543, 575, 611

[56] References Cited

U.S. PATENT DOCUMENTS

| | | | |
|---|---|---|---|
| 2,690,552 | 9/1954 | Kiibus | 40/564 |
| 2,699,620 | 1/1955 | Smythe | 40/564 |
| 3,056,222 | 10/1962 | Boudouris | 40/572 |
| 3,751,319 | 8/1973 | Green et al. | 40/615 |
| 3,990,166 | 11/1976 | Nagelkirk | 40/574 |
| 3,997,991 | 12/1976 | Hayman-Chaffey et al. | 40/564 |
| 4,261,125 | 4/1981 | Rappaport | 40/564 |
| 4,277,904 | 7/1981 | Leuthesser | 40/564 |
| 4,516,344 | 5/1985 | Seely | 40/606 |
| 4,854,063 | 8/1989 | Brunell | 40/607 |

FOREIGN PATENT DOCUMENTS

| | | | |
|---|---|---|---|
| 586155 | 11/1959 | Canada | 40/564 |
| 540857 | 3/1956 | France | 40/564 |
| 7807546 | 7/1978 | Netherlands | 40/607 |
| 723354 | 2/1955 | United Kingdom | 40/564 |

*Primary Examiner*—Laurie K. Cranmer
*Assistant Examiner*—Brian K. Green
*Attorney, Agent, or Firm*—Phillips & Beumer

[57] ABSTRACT

An illuminated, box-type telephone sign having an integral display box supported by a rigid member at only one end of the box. The support member is in the form of a rectangular trough made of resin formed by a cold casting process. The display box have five sides and an open end that fits over and is secured to edges of the supporting member. Support for electrical lamps such as concentric fluorescent bulbs and other electrical components is provided by a bracket connected to the support member and without any connection to the display box. A U-shaped sleeve that slides over front, back, and end faces of the box is also disclosed. The structure avoids the use of a peripheral metal frame for the box and braces connected to such frame, thus providing easier installation and more ready access for maintenance. The lack of a peripheral frame also makes additional faces of the sign available for graphics.

1 Claim, 4 Drawing Sheets

ILLUMINATED SIGN WITH SELF-SUPPORTING DISPLAY BOX

FIELD OF THE INVENTION

This invention relates generally to illuminated signs and more particularly to box-type signs for use in proximity to public telephones.

BACKGROUND OF THE INVENTION

Signs for advertising the location of public telephones generally are constructed in a square or rectangular configuration with wording and/or graphics denoting the location of a telephone being visible from front and back faces. The most widely used of such signs has an extruded aluminum frame structure extending around its periphery and defining the thickness of the sign. Grooves are provided inside the frame for supporting front and back plastic faces which are slid into position when one side of the frame is swung up to the disengaged position by being pivoted around a hinge provided for that purpose. Upon insertion of the sign faces, the hinge frame side is rotated downward and secured in engaged position by being connected to an adjacent side of the frame. Internal components of the sign, including fluorescent light fixtures, ballasts, and necessary wiring, are supported along one side of the frame and on brackets that extend across the sign, the bracket being connected at their ends to other, opposing sides of the frame. This type of sign is exemplified by the PB-23 Lighted Sign available from Phillips & Brooks, Inc., Cumming, Ga.

A sign structure having a perimeter frame of extruded material for supporting front and back sign faces is also disclosed in U.S. Pat. No. 4,205,471, issued June 3, 1980, to Coleman, and in U.S. Pat. No. 4,317,302, issued Mar. 2, 1982, to Sernovitz. All of these signs include peripheral metal frames for securing sign faces and internal clamps or brackets connected to opposing sides of the frame. These features tend to interfere with access to the sign interior and to complicate installation and maintenance procedures. In addition, the presence of a peripheral metal frame keeps the frame sides from being illuminated internally so that the sides would not be suitable for graphic displays. It is desired to provide an illuminated sign of simpler construction that avoids the need for a peripheral frame support and that has frame sides as well as faces available for graphic display.

SUMMARY OF THE INVENTION

The present invention is directed to an illuminated rectangular sign that has a self-supporting, five-sided display box with an open end. The box is attachable at its open end to a rigid member that forms the sixth sides of the box and provides a receptacle for attachment of the box thereto. The rigid member provides all necessary support for illuminating lamps and other components. This simplified construction enables easier installation and provides more ready access to the sign interior for performing maintenance. The lack of a peripheral frame allows three side faces as well as front and back faces of the display box to be illuminated, thus providing more space for graphic displays. I have found that a rigid support member preferably made by cold casting of a plastic resin provides sufficient support for an attached display box connected thereto only at its open end. All necessary support for illuminating lamps and associated components may be provided by attachment to the support member, leaving the interior of the display box unencumbered with connections to brackets or clamps. The display box may comprise a plastic material such as polycarbonate fabricated from heavy sheet material in a manner such as to have sufficient strength and rigidity.

It is, therefore, an object of this invention to provide a rectangular box-type illuminated sign that does not require a peripheral frame or internal braces to support its display box.

Another object is to provide an illuminated box sign having a display box supported at only one end thereof.

Another object is to provide a telephone sign of simplified construction, enabling easier installation and maintenance.

Another object is to provide an illuminated telephone sign that has an illuminated display space available on side faces as well as front and back faces.

Other objects and advantages will be apparent from the following detailed description and claims.

Description of the Preferred Embodiment

Figure 1:
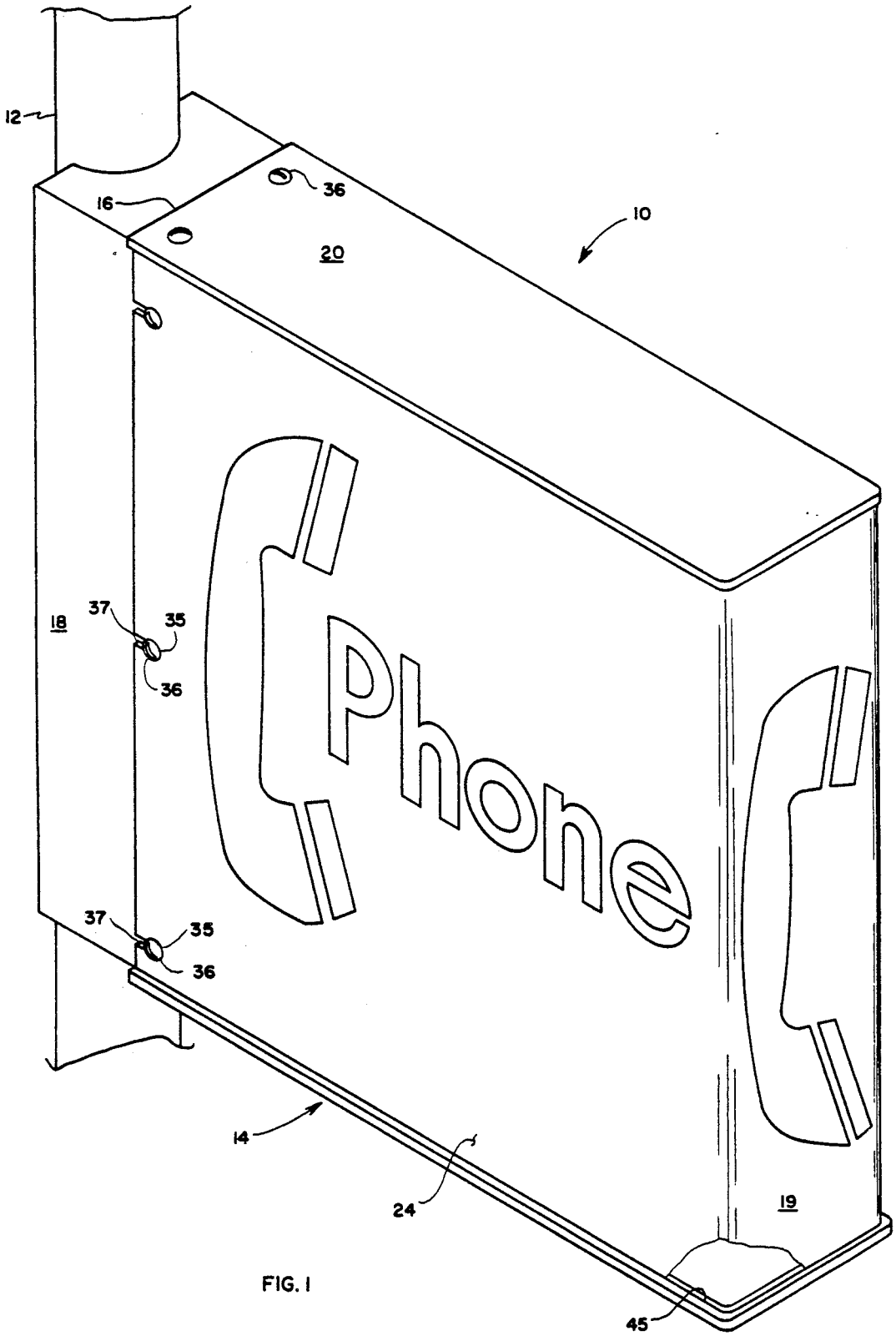
FIG. 1 is a pictorial view of a telephone sign embodying the invention.
Figure 2:
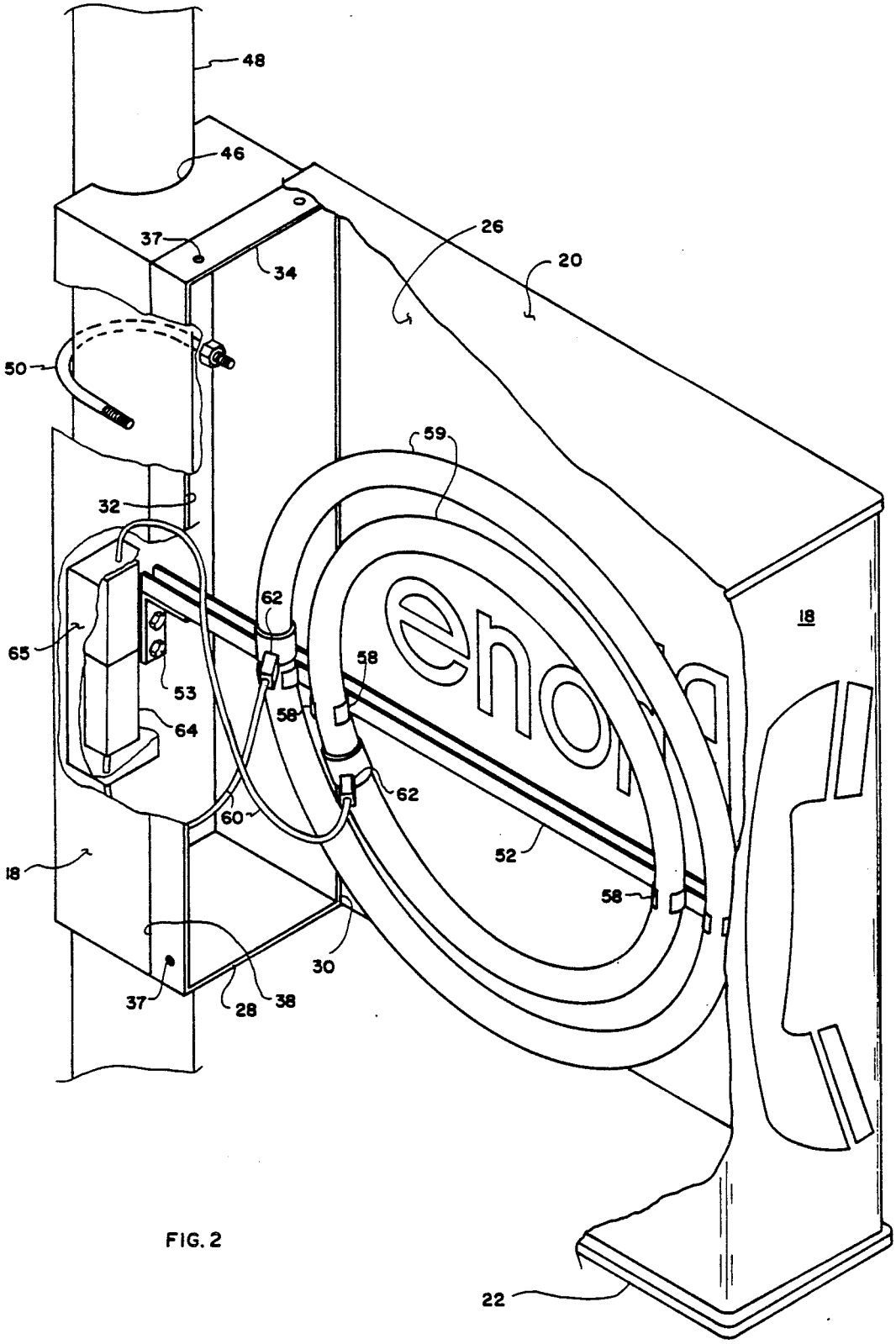
FIG. 2 is a pictorial view, partly broken away, showing internal components of a telephone sign.

Referring to FIGS. 1 and 2 of the drawings, a telephone sign 10 is shown mounted on a round post 12. The sign has a one-piece display box 14 with an open end 16 that is secured to a rigid supporting member 18 in the form of a rectangular trough. Display surfaces are provided by end face 19, top face 20, and bottom face 22 of the box as well as by front face 24 and back face 26. The display box is secured at its open end to the supporting member by being slid over edges 28, 30, 32, and 34 of the support member so as to be in contact with the member and arranged in overlapping relation thereto. Screws 36 penetrating the box and support member through end portions 35 of slots 37 at the overlapped area hold the box in position. Top and bottom faces may be provided with grooves 45 on the inside thereof spaced to receive top and bottom edges of the side and end faces so as to facilitate assembly of the box.

Support member 18, as shown in FIG. 2, has a rectangular trough shape with its outer edges adapted to have the open end of the box slid over the edges and held in contact therewith for being supported. At its closed end, the support member is provided with a longitudinal notch 46 of semi-circular cross section to facilitate its being mounted securely on a round mast pole 48 by means such as U-bolts 50. The support member has an L-shaped bracket 52 rigidly secured to the bottom of the base member by screws 53 that penetrate the base portion of the bracket. The bracket extends perpendicular to the open edges of the support member. Bracket 52 has secured to one of its sides two pairs of snap-in holders 58 for securing two circular fluorescent light bulbs 59, one disposed concentrically inside the other. Wires 60 connect plugs 62 of the light bulbs to ballasts 64 which are secured to the base of the support member. The ballasts are enclosed by a protective metal cover 65. As may be seen, none of the hardware for supporting the bulbs and associated electrical components is connected to the display box, and ready access is provided upon removal of the box. Wires (not shown) extend outwardly through an opening in the bottom of the support member for connection to an A.C. circuit, the wires being threaded through the opening provided in the mast pole for that purpose. When the sign is mounted vertically or horizontally on a flat surface, the circular notch may serve as a conduit or chase for threading the wires outwardly.

Figure 3:
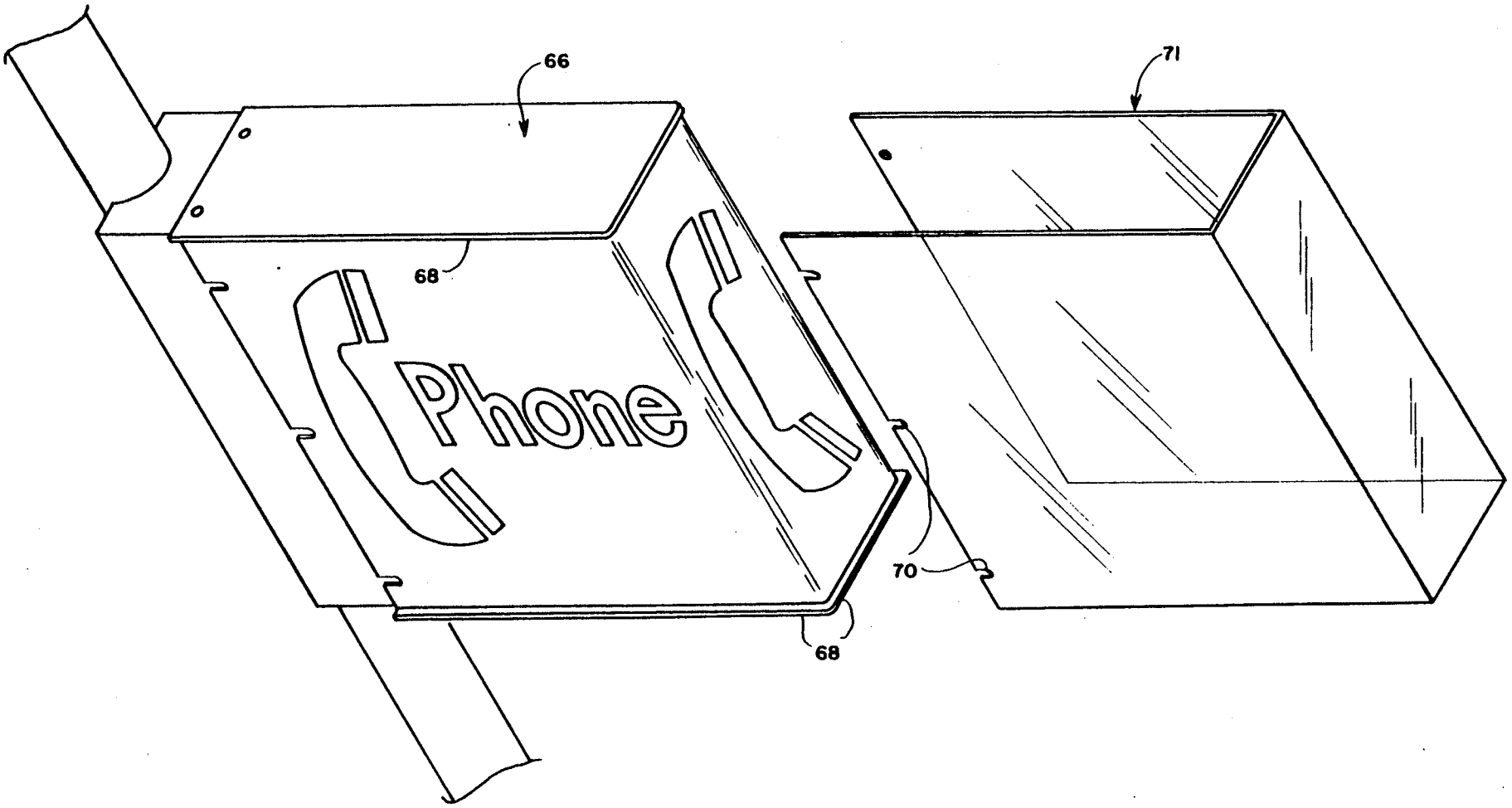
FIG. 3 is a pictorial view of an embodiment that includes an external sleeve.

FIG. 3 shows an embodiment wherein a display box 66 is provided with ledges 68 that are extensions of its top and bottom faces, the ledges being adapted to slidably receive a transparent sleeve 71 of U-shaped configuration. Upon being slid into position over the display box, the sleeve may be secured by means of screws applied through holes 70. This arrangement provides protection to graphic materials applied to the box. For a vertically mounted sign, the sleeve would be disposed horizontally in relation to the box, and the graphics would be placed parallel to an upper edge of the sleeve as shown. Such a sleeve arrangement may also be used for a horizontally mounted sign, in which case the graphics on the box would be placed parallel to a side edge of the sleeve. This allows one type of display box to be used for both vertical and horizontal mounting applications, with appropriate graphics orientation being selected as desired.

Figure 4:
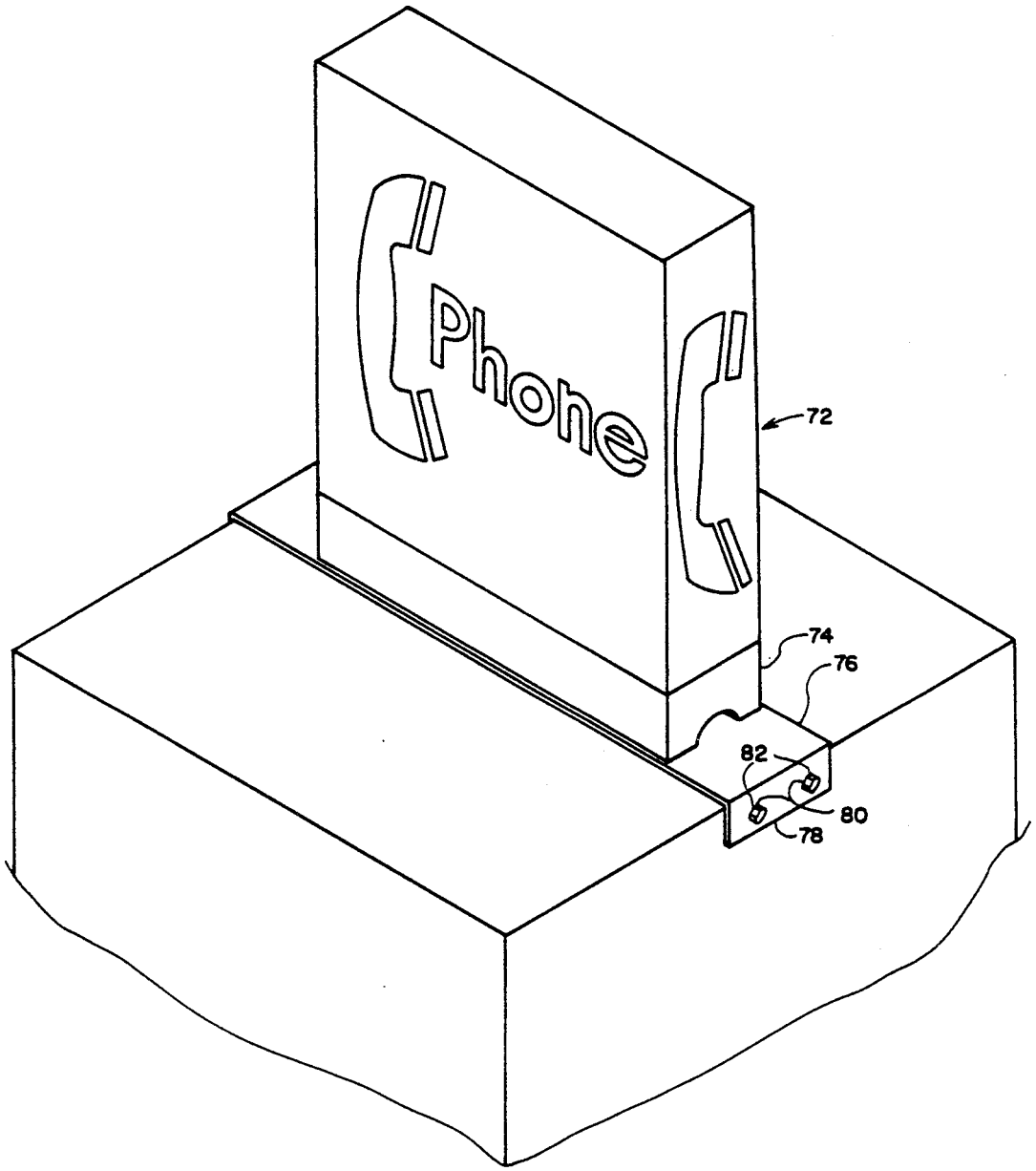
FIG. 4 is a pictorial view showing a sign mounted horizontally on top of a telephone booth.

Horizontal mounting of the sign on top of a telephone booth or other horizontal surface is shown in FIG. 4. In this embodiment, a display box 72 is secured to supporting member 74 as described above, and the bottom of the support member is connected by means not shown to a horizontally extending bracket 76 in the form of a plate having a right angle bend 78 at its ends to enclose an upper corner of a telephone booth and including holes 80 for insertion of screws 82. Signs embodying the invention may also be mounted horizontally or vertically on other supports such as walls.

In another embodiment of the invention, a smaller display sign is provided having its front and back faces relatively narrow and approximately equal to the width of the top and bottom faces. For this embodiment, a straight fluorescent light bulb secured to the base member would be used.

The support member may be fabricated by means of a "cold cast" process by providing a mold conforming to the exterior shape of the support member, applying to the mold surface a layer of a resin such as Gelcoat TM polyester resin and allowing the mixture to harden. The mixture may be applied by brushing to a thickness of $\frac{1}{8}$ to $\frac{1}{4}$ inch. No pressure or heat need be applied. After this layer has hardened, a reinforcing layer of a chopped fiberglass-resin mixture may also be applied, preferably to a thickness of $\frac{3}{8}$ inch. The fiberglass-resin mixture may be applied by spraying the mixture with a device that provides for chopping fiberglass fibers as well as mixing and spraying. Support members prepared in this manner have a high degree of strength and rigidity, enabling support of internal components of the sign as well as a display box without any brackets or braces connected to the display box.

The display box may be constructed from plastic sheet material, preferably Solar Grade LEXAN® polycarbonate. Front and back faces and the outside face for the arrangement shown in FIG. 1 may be prepared from one piece of material by bending by means of applying pressure to obtain a U-shaped piece with two right angle bends. Top and bottom faces are provided by separate pieces, which are preferably provided with grooves 45 to receive edges of the front and back and side faces. Top and bottom faces may be secured to the U-shaped pieces by a cohesive bonding process in which a cohesive bonding agent such as methylene chloride is applied along the desired seam and the pieces are pressed together, rapidly forming a strong joint. Top and bottom face pieces may be made slightly larger than the thickness of the box to provide a ledge for securing a sleeve and to enable a greater tolerance than would be required for forming exact corners.

While the invention is described above with respect to telephone signs, it is not to be understood as so limited but may be applied to signs for other purposes by use of appropriate graphics. The invention also is not to be understood as limited to the specific embodiments described but is limited only as indicated by the appended claims.

I claim:

1. An illuminated box sign comprising:

a rigid, generally rectangular trough support member having a base portion and four sides integral therewith, edges of said sides providing a receptacle of rectangular cross section, said support member being made of a plastic resin formed by casting and including a layer of fiberglass-containing resin;

a rectangular plastic display box in the form of an integral five-sided unit defining front and back direct viewing faces, top and bottom faces between the front and back faces, an end face and an open end adapted to fit onto the receptacle of the support member in overlapping relation therewith, said top and bottom faces extending outwardly slightly from their juncture with the front, back, and rear faces, providing top and bottom ledges;

at least one electric lamp disposed in said display box and secured to said support member;

electric lamp activating means secured to said support member;

means securing said display box to said support member at their overlapped region; and a U-shaped sleeve adapted to fit over said front, back, and end faces, with edges of said sleeve in contact with said ledges.

* * * * *